US006517387B1

(12) United States Patent
Huang

(10) Patent No.: US 6,517,387 B1
(45) Date of Patent: Feb. 11, 2003

(54) RADIO FREQUENCY CABLE CONNECTOR ASSEMBLY

(75) Inventor: Chien Shun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/969,401

(22) Filed: Oct. 1, 2001

(30) Foreign Application Priority Data

Aug. 31, 2001 (TW) ..... 90215032 U

(51) Int. Cl.[7] ..... H01R 13/64
(52) U.S. Cl. ..... 439/680; 439/578
(58) Field of Search ..... 439/578–585, 439/607, 610, 677–681

(56) References Cited

U.S. PATENT DOCUMENTS 3,671,922 A * 6/1972 Zerlin et al. ..... 439/578
4,229,064 A * 10/1980 Vetter et al. ..... 439/578
4,611,878 A * 9/1986 Hall et al. ..... 439/578
4,904,206 A * 2/1990 Laudig et al. ..... 439/578
5,618,190 A * 4/1997 Masuda et al. ..... 439/610
6,267,621 B1 * 7/2001 Pitschi et al. ..... 439/578

* cited by examiner

*Primary Examiner*—Hien Vu
(74) *Attorney, Agent, or Firm*—Wei Te Chung

(57) ABSTRACT

A radio frequency cable connector assembly comprises a first connector (1) and second connector (2), wherein the first connector includes a first metallic housing (10), a first insulator (11) fixed in the first housing, an elastic metallic sleeve (13) secured between the first housing and the first insulator, and ridges (133) formed on the elastic sleeve. The second connector includes a second metallic housing (20), a second insulator (21) fixed in the second housing, and a groove (204) defined in the second housing. An alignment slot (102) and an alignment key (205) are formed on the first and second connectors, respectively. When the first and second connectors are coupled together, the sleeve and the second housing electrically connect together, the ridges engage in the groove, and the key is fitted in the slot to thereby prevent relative rotation between the first and second connectors.

1 Claim, 3 Drawing Sheets

RADIO FREQUENCY CABLE CONNECTOR ASSEMBLY

BACKGROUND OF THE INVENTION

1. Field of the Invention

The present invention relates to radio frequency (RF) cable connector assemblies, and more particularly to RF cable connector assemblies which have mated first and second connectors that may still be liable to rotational displacement.

2. Related Art

A conventional cable connector assembly is disclosed in U.S. Pat. No. 5,611,707. It provides a microminiature coaxial connector assembly which locks by snap fastening. The assembly comprises a first connector and a second connector. The first connector has an elastic socket protruding from a cavity, and a pin contact. The elastic socket forms an annular bead at a front thereof. The second connector includes an insulative skirt, an annular groove defined rearwardly of the skirt, and a socket contact. When coupling, the elastic socket firstly engages within the insulative skirt. This pre-positions the contacts of the two connectors relative to each other. Then the skirt is fittingly received in the cavity. Finally, the bead snap fastens in the groove, thus strengthening the retaining force of the assembly. However, when force perpendicular to the direction of coupling is applied to either connector, that connector may twist relative to the other connector. Such twisting can disturb electrical connection between the contacts of the two connectors, or even damage the contacts. In other words, the assembly does not prevent the two connectors from rotating relative to each other after mating. Thus the assembly is liable to provide unstable and unreliable signal transmission.

BRIEF SUMMARY OF THE INVENTION

It is an object of the present invention to provide a cable connector assembly for ensuring safe engagement and firm alignment between two complementary cable connectors.

A radio frequency cable connector assembly in accordance with the invention comprises a first connector and second connector. The first connector includes a first metallic housing, an inner tubular portion depending from the first housing, a first insulator fixed in the first housing, a first contact fixed in the first insulator, an elastic metallic sleeve secured between the first metallic housing and the first insulator, and a ridge formed on the elastic metallic sleeve. The second connector includes a second metallic housing, a second insulator fixed in the second housing, a second contact fixed in the second insulator, and a groove defined in the second housing. An outer tubular portion is fitted on the first housing, and encircles the inner tubular portion. A cable is attached to the first connector. The cable has a central conductor electrically connecting with the first contact of the first connector for transmitting radio frequency signals, an insulator, and a ground braiding electrically connecting with the inner and outer tubular portions. At least one alignment slot and one alignment key are formed on the first and second connectors, respectively. When the first and second connectors are coupled together, the first and second contacts engage with each other, the sleeve and the second metallic housing electrically connect together, the ridge of the sleeve of the first connector engages in the groove of the second metallic housing, and the key is fitted in the slot to thereby prevent relative rotation between the first and second connectors.

A more complete appreciation of the present invention and the scope thereof can be obtained from the accompanying drawings which are briefly summarized below, the following detailed description of the preferred embodiment of the present invention, and the appended claims.

DESCRIPTION OF THE PREFERRED EMBODIMENT

Figure 1:
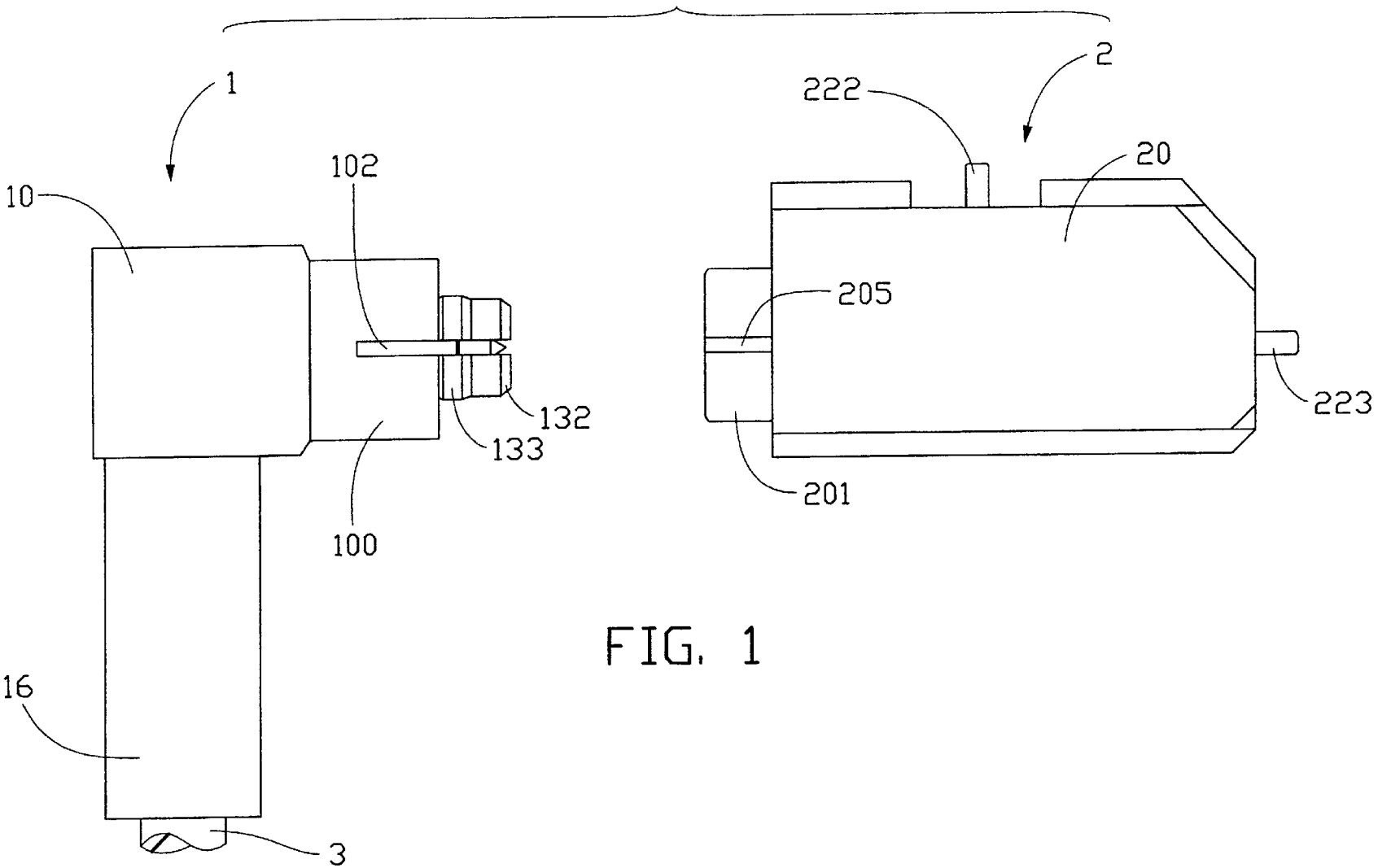
FIG. 1 is a side elevation view of a cable connector assembly in accordance with a preferred embodiment of the present invention, showing first and second connectors.
Figure 4:
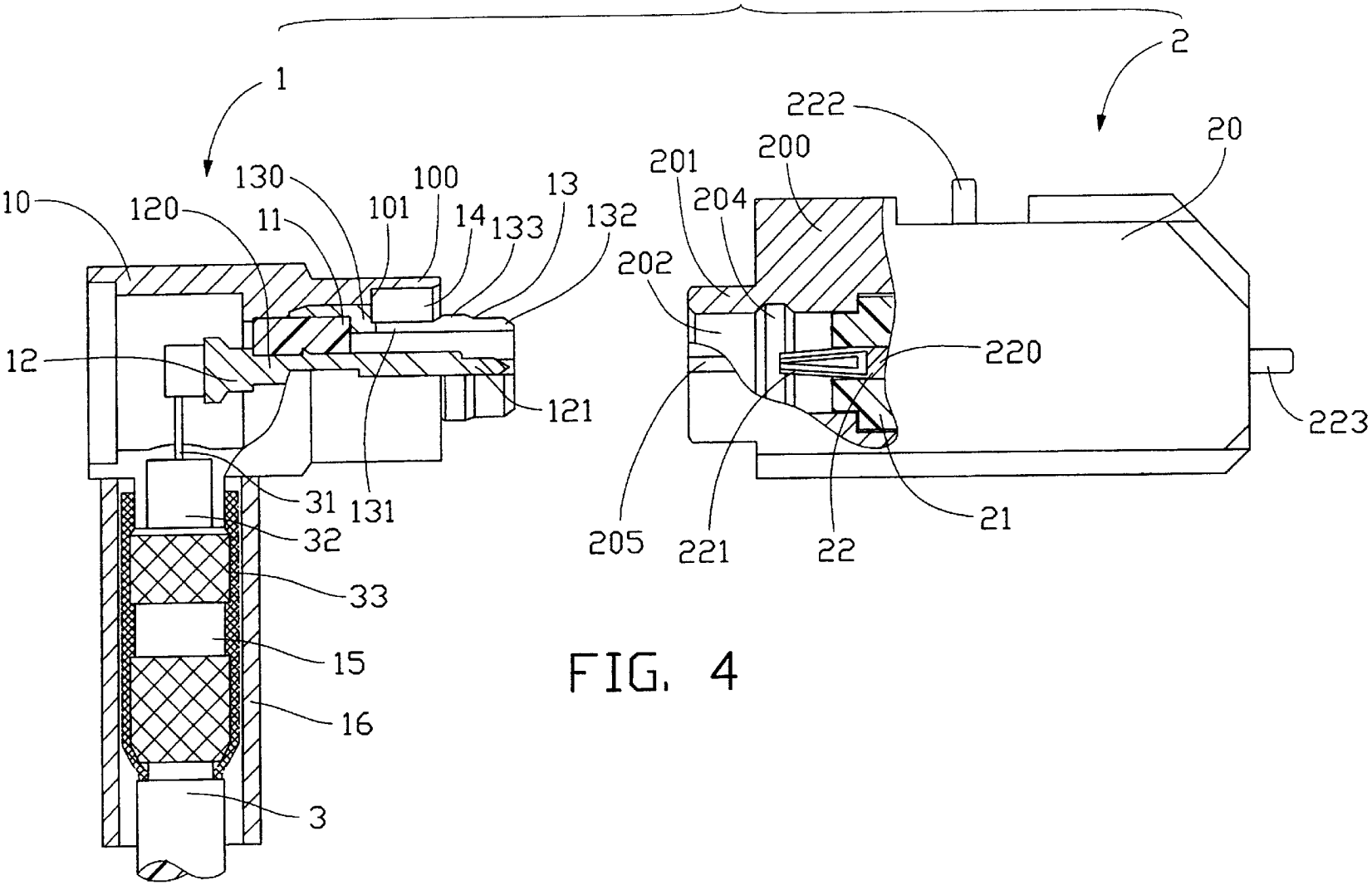
FIG. 4 is similar to FIG. 1, but with parts of the first and second connectors cut away to show cross-sectional views thereof.

Referring to FIGS. 1 and 4, a cable connector assembly in accordance with a preferred embodiment of the present invention comprises a first connector 1 and a second connector 2 for coupling with the first connector 1. The first connector 1 comprises a first metallic housing 10, an inner tubular portion 15 depending from the first housing 10, an first insulator 11, and a first contact 12 received within the first insulator 11. An outer tubular portion 16 is fitted on the first housing 10 and encircles the inner tubular portion 15. A cable 3 is attached to the first connector 1. The cable 3 includes a central conductor 31 within the inner tubular portion 15 for electrically connecting with the first contact 12 to transmit RF signals, an insulator 32, and a ground braiding 33 extending between the inner and outer tubular portions 15, 16 for electrically connecting the first housing 10 to ground. The insulator 11 and the first contact 12 are both accommodated in the first housing 10. The first housing 10 has a front portion 100. A first receiving space 14 is defined in the front portion 100. An internal annular step 101 is thus formed in the first housing 10. A horizontal alignment slot 102 is defined in the front portion 100. The first contact 12 includes a first positioning portion 120 secured in the first insulator 11, and a first coupling portion 121 extending forwardly from the first positioning portion 120. In the preferred embodiment, the first coupling portion 121 is a round pin. An elastic metallic sleeve 13 is positioned between the front portion 100 of the first housing 10 and the first insulator 11. The sleeve 13 includes a retaining portion 130 fixedly sandwiched between the first housing 10 and the first insulator 11, and an elastic portion 131 extending forwardly from the retaining portion 130. Part of the elastic portion 131 is disposed within the first receiving space 14, and another part of the elastic portion 131 protrudes out beyond the front portion 100. The elastic portion 131 comprises four spring leaves (not labeled) arranged in a circle to surround the first coupling portion 121. Each spring leaf includes a tapered front guiding edge 132, and a ridge 133 formed on an arcuate periphery of the spring leaf. The ridge 133 is located between the guiding edge 132 and the front portion 100.

The second connector 2 comprises a hollow second metallic housing 20, a second insulator 21 retained in the second housing 20, and a second contact 22 retained in the second insulator 21. The second housing 20 includes a main body 200 having a front cylindrical protrusion 201. A step (not labeled) is thus formed between the protrusion 201 and the main body 200. A horizontal alignment key 205 is formed on a circumferential periphery of the protrusion 201, for engaging in the slot 102 of the first connector 1. An annular groove 204 is defined in an inner wall of the main body 200, immediately rearwardly of the protrusion 201. A second receiving space 202 is integrally defined through the protrusion 201 and in the main body 200. A front of the protrusion 201 has an annular chamfer adjacent the second receiving space 202, such that the second receiving space 202 is flared at a frontmost portion thereof. The second contact 22 includes a second positioning portion 220 retained in the second insulator 21, a second coupling portion 221 protruding beyond a front of the second insulator 21 into the second receiving space 202, and a rear contact 223 protruding beyond a rear of the second connector 2. In the preferred embodiment, the second coupling portion 221 is forked. The second connector 2 further comprises a top contact 222 located on a top portion thereof.

The second housing 20 is soldered to a ground point of a printed circuit board (not shown). The rear contact 223 electrically connects with a signal source circuit (not shown), and the top contact 222 electrically connects with an internal output circuit (not shown). When the first and second connectors 1, 2 are not mated together, the second contact 22 is electrically connected with the top contact 222. On the other hand, when the first and second connectors 1, 2 are mated together, the second contact 22 is electrically separated from the top contact 222. In an alternative embodiment of the present invention, the first connector 1 has more than one slot 102, and the second connector 2 has more than one corresponding key 205.

Figure 3:
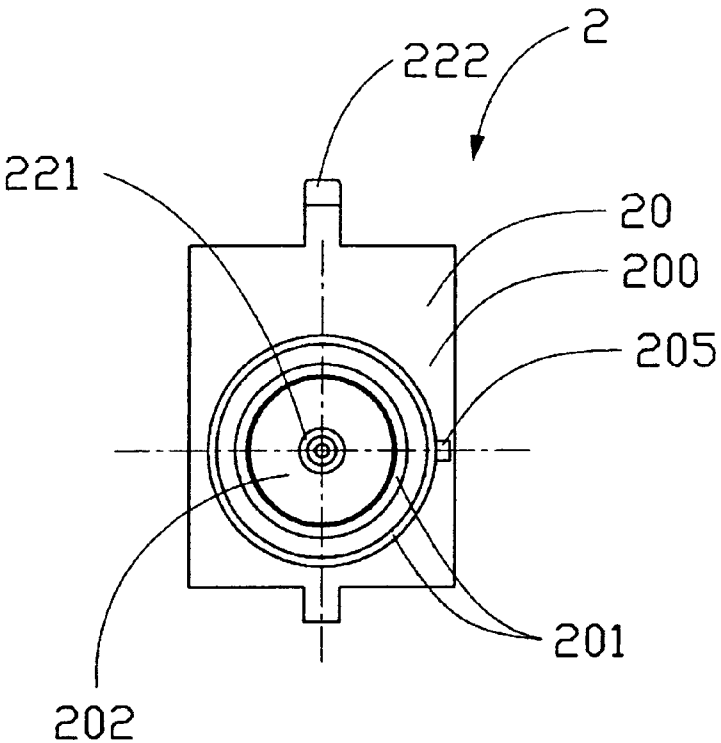
FIG. 3 is a front elevation view of the second connector of FIG. 1.
Figure 2:
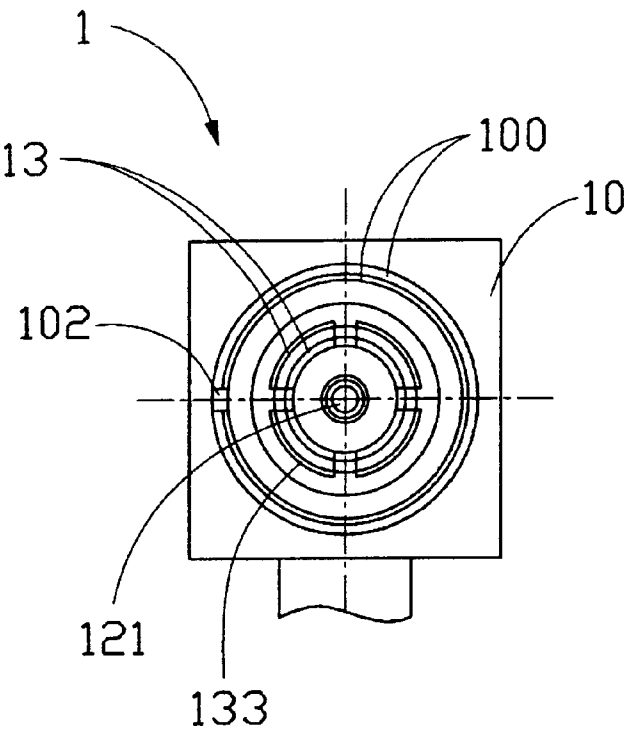
FIG. 2 is a front elevation view of the first connector of FIG. 1.

Referring to FIGS. 1–3, in mating, the slot 102 of the first connector 1 is aligned with the key 205 of the second connector 2. The sleeve 13 of the first connector 1 is inserted into the second receiving space 202 of the second connector 2, with the key 205 fitting into the slot 102. Simultaneously, the first coupling portion 121 of the first contact 12 inserts into the second coupling portion 221 of the second contact 22 to electrically engage therewith. Further, the ridges 133 of the sleeve 13 engage with the main body 200 of the second housing 20 in the groove 204. Thus the first and second housings 10, 20 are electrically connected together. The protrusion 201 is received in the first receiving space 14, and an annular front edge of the protrusion 201 abuts against the step 101. The tapered front guiding edges 132 of the sleeve 13 and the flared configuration of the second receiving space 202 facilitate insertion of the sleeve 13 into the second receiving space 202.

Once the first and second connectors 1, 2 have been mated, the engagement of the key 205 in the slot 102 prevents the first and second connectors 1, 2 from rotating relative to each other. Thus, the engagement of the first and second contacts 12, 22 is secure and stable. Accordingly, signals transmitted through the first and second contacts 12, 22 of the connector assembly are stable and reliable.

The scope of the present disclosure includes any novel feature or combination of features disclosed therein either explicitly or implicitly, or any generalization thereof, irrespective of whether or not such feature, combination or generalization relates to the claimed invention or mitigates any or all of the problems addressed by the present invention. The applicant hereby gives notice that new claims may be formulated regarding such feature, combination or generalization during prosecution of this application or of any further application derived from this application.

I claim:

1. A radio frequency cable connector assembly comprising:

a first connector including a first metallic housing, a tubular portion extending from the first housing, a first insulator fixed in the first housing, a first contact fixed in the first insulator and an elastic metallic sleeve secured between the first housing and the first insulator, the sleeve forming an annular ridge on a periphery thereof, the ridge being located in front of a front end of the first housing;

a second connector including a second metallic housing, a second insulator fixed in the second housing, a second contact having a positioning portion fixed in the second insulator, and a coupling portion protruding beyond a front of said second insulator, the second housing defining an annular groove therein;

a cable attached to the first connector, the cable having a central conductor electrically connecting with the first contact for transmitting radio frequency signals, an insulator, and a ground braiding electrically connecting with the tubular portion of the first connector; and only one alignment slot and one alignment key formed on the first and second connectors, respectively;

wherein when the first and second connectors are coupled together, the first and second contacts engage with each other, the sleeve and the second housing electrically connect together, the ridge of the sleeve of the first connector engages in the groove of the second housing, and the at least one alignment key is fitted in the at least one alignment slot thereby preventing the first and second connectors from rotating relative to each other; wherein the first housing of the first connector includes a recessed front portion defining a space therein, the sleeve extends through the space, the second housing of the second connector includes a front protrusion received in the space of the first housing, the alignment slot is defined in a periphery of the recessed front portion of the first housing, and the alignment key is formed on a periphery of the front protrusion of the second housing.

* * * * *